US005726134A

United States Patent [19]

Adams

[11] Patent Number: 5,726,134

[45] Date of Patent: Mar. 10, 1998

[54] MULTIGRADE LUBRICATING COMPOSITIONS

[75] Inventor: David Robert Adams, Oxfordshire, United Kingdom

[73] Assignee: Exxon Chemical Patents Inc., Wilmington, Del.

[21] Appl. No.: 750,768

[22] PCT Filed: Jul. 7, 1995

[86] PCT No.: PCT/EP95/02696

§ 371 Date: Dec. 13, 1996

§ 102(e) Date: Dec. 13, 1996

[87] PCT Pub. No.: WO96/01885

PCT Pub. Date: Jan. 25, 1996

[30] Foreign Application Priority Data

Jul. 11, 1994 [GB] United Kingdom ..... 9413976

[51] Int. Cl.[6] ..... C10M 163/00

[52] U.S. Cl. ..... 508/391; 508/241; 508/503; 508/580

[58] Field of Search ..... 508/391, 241, 508/503, 580

[56] References Cited

U.S. PATENT DOCUMENTS

| | | | |
|---|---|---|---|
| 5,277,833 | 1/1994 | Song et al. | 508/241 |
| 5,328,620 | 7/1994 | Ripple | 508/391 |
| 5,435,926 | 7/1995 | Gutierrez et al. | 508/507 |

FOREIGN PATENT DOCUMENTS

| | | |
|---|---|---|
| 277729 | 1/1988 | European Pat. Off. . |
| 353935 | 7/1989 | European Pat. Off. . |
| 490454 | 12/1991 | European Pat. Off. . |

*Primary Examiner*—Jacqueline V. Howard
*Attorney, Agent, or Firm*—Ohlandt, Greeley Ruggiero & Perle

[57] ABSTRACT

Multigrade lubricating oils which have acceptable performance in the VWInTD and Sequence VE engine tests and which are based on an ashless dispersant comprising an oil-soluble polymeric backbone having functional groups in which the hydrocarbon backbone is derived from an ethylene alpha-olefin (EAO) copolymers or alpha-olefin homo- or copolymer having greater than 30% of terminal vinylidene unsaturation achieve this performance by use of a detergent combination which includes a phenate in the formulation of the oils.

23 Claims, No Drawings

MULTIGRADE LUBRICATING COMPOSITIONS

This invention relates to lubricating oil compositions and in particular to crankcase lubricating oil compositions for use as passenger car motor oils and heavy duty diesel oils.

Lubricating oils as used in, for example, the internal combustion engines of automobiles or trucks are subjected to a demanding environment during use. Combustion and/or oxidation products from burning and/or oxidation of fuel, lubricating oil and nitrogen in the air as well as products of the thermal and oxidative degradation of hydrocarbon lubricating oils and additives thereto tend to concentrate in the crankcase oil. These products tend to form oil-insoluble products that either surface coat metal parts with lacquer or varnish-like films or settle out as viscous sludge deposits or form ash-like solids or carbonaceous deposits. Any of these deposits can restrict and even plug grooves, channels and holes provided for lubricant flow to moving surfaces requiring lubrication. Lubricating oil formulations are therefore formulated to not only to reduce the magnitude of these oil insoluble products but also to minimise their impact by keeping them in suspension through the use of dispersants and/or to re-suspend them with a a detergent which also acts to neutralise acidic products.

Dispersant additives for lubricating oils are typically ashless materials which have a polymeric hydrocarbon backbone and functional groups capable of associating with particles to be dispersed and which are connected to the polymer backbone via a bridging group. Widely used conventional dispersants are those based on polyisobutene substituted succinic acids or arthydrides which are reacted with hydroxyl compounds or amines, such as for example polyisobutenyl succinic arthydrides reacted with polyamines, for convenience referred to as PIBSA/PAM ashless dispersants.

Typically the detergents used in lubricating oils are neutral and/or overbased alkaline earth metal salts of carboxylic acids, substituted phenols and their sulfurised derivatives, substituted salicylic acids and substituted sulfonic acids.

Modern lubricating oils and especially heavy duty diesel oils are facing increasingly stringent requirements for deposit control and liner wear reduction. In the prior art and historically detergents have been the most effective in reducing the high temperature deposits which are produced in heavy duty diesel engines and have also been effective in preventing or keeping to a minimum bore polish. There has also been an increasing pressure on formulators to ensure that their products have the required environmental properties. One of these properties is to provide additives and compositions which can be used in low ash lubricating oil formulations. One of the main sources of ash are the metal containing detergents.

There is also a strong desire to be able to provide lubricating oil compositions and concentrates which have universal application as both heavy duty diesel and also passenger car motor oils.

EP 0277729 B1 describes lubricating oil additive compositions which are said to provide wear protection at reduced phosphorus levels when used to formulate oils. The composition comprises a specific type of ZDDP, a succinamide dispersant which is derived from polybutene and propoxylated hexamethylenediamine, boron, and high base metal sulfonates and/or phenates as well as other additives.

Lubricating oil formulations which are based on widely used conventional dispersants such as PIBSNPAM dispersants whilst having acceptable performance in relation to heavy duty diesel applications have shortcomings in the passenger car motor oil area where they are unable to easily meet the requirements of the Sequence VE engine test the purpose of which is to evaluate an oils sludge wear and varnish performance under high-, medium- and low-temperature conditions. These requirements are usually met by using a higher treat rate of the dispersant however this increase can result in viscosity problems with a consequential reduction in formulating flexibility.

A new class of ashless dispersants comprising functionalized and/or derivatized olefin polymers based on polymers which may be synthesised using metallocene catalyst systems (described for example in U.S. Pat. Nos. 5,128,056, 5,151,204, 5,200,103, 5,225,092, 5,266,223, 5,334,775; WO-A-94/19436, 94/13709; and EP-A-440506, 513157, 513211 and in more detail below) have acceptable performance in the Sequence VE engine test.

The present invention is concerned with the problem of providing lubricating oil formulations based on this new class of ashless dispersants which not only meet the requirements of the Sequence VE test but which also provide acceptable dispersancy and diesel piston cleanliness especially in heavy duty diesel (HDD) and passenger car (PCMO) lubricating oil formulations.

Surprisingly it has been found that lubricating oil compositions and concentrates based on ashless dispersants comprising functionalized and/or derivatized olefin polymers based on polymers which may be synthesised using metallocene catalyst systems, can be formulated to meet both the requirements of the Sequence VE and the requirements of the VWInTD engine tests for PCMO and HDD oils by selecting a specific detergent system for use in combination with these dispersants. This combination provides formulations which have acceptable dispersancy and diesel piston cleanliness as exhibited in the Volkswagen Intercooled Turbo Diesel (VWInTD) engine test which has as its purpose to test the effect of an oil on ring sticking and piston deposits in a turbocharged passenger car diesel engine. This advantage is especially significant for high quality heavy duty diesel oils which typically require high concentrations of dispersant additives and especially detergents.

Accordingly the present invention therefore provides a lubricating oil composition comprising:

(a) an oil of lubricating viscosity, (b) an ashless dispersant comprising an oil-soluble polymeric backbone having functional groups in which the hydrocarbon backbone is derived from an ethylene alpha-olefin (EAO) copolymer or alpha-olefin homo- or copolymer having greater than 30% of terminal vinylidene unsaturation, and (c) two or more detergents comprising at least one alkali metal or alkaline earth metal phenate or salicylate which is present at a level such that the soap derived from the phenate or salicylate provides >32 and <50 wt % of the total soap in the composition.

The present invention also provides for a lubricating oil concentrate comprising;

(a) an oil of lubricating viscosity as a minor component;

(b) an ashless dispersant comprising an oil-soluble polymeric backbone having functional groups in which the hydrocarbon backbone is derived from an ethylene alpha-olefin (EAO) copolymer or alpha-olefin homo- or copolymer having greater than 30% of terminal vinylidene unsaturation, and (c) two or more detergents comprising at least one alkali metal or alkaline earth metal phenate or salicylate which is present at a level such that the soap derived from the phenate or salicylate provides >32 and <50 wt % of the total soap in the concentrate.

The invention further provides for a lubricating oil concentrate comprising;

(a) an oil of lubricating viscosity as a minor component;

(b) an ashless dispersant comprising an oil-soluble polymeric backbone having functional groups in which the hydrocarbon backbone is derived from an ethylene alpha-olefin (EAO) copolymer or alpha-olefin homo- or copolymer having greater than 30% of terminal vinylidene unsaturation, and (c) at least one alkali metal or alkaline earth metal phenate or salicylate present in the concentrate at a level such that a lubricating oil composition prepared from the concentrate comprises soap derived from the phenate or salicylate in the range >32 and <50 wt % of the total soap in the lubricating oil composition.

The invention further provides for the use in a lubricating oil composition of the additive combination of;

(a) an ashless dispersant comprising an oil-soluble polymeric backbone having functional groups in which the hydrocarbon backbone is derived from an ethylene-olefin (EAO) copolymer or alpha-olefin homo- or copolymer having greater than 30% of terminal vinylidene unsaturation, and (b) two or more detergents comprising at least one alkali metal or alkaline earth metal phenate or salicylate which is present at a level such that the soap derived from the phenate or salicylate provides at least 10 wt % of the total soap in the composition, to provide a lubricating oil composition with acceptable ring sticking performance in the VWInTD test.

The invention further provides for the use in a lubricating oil composition of such an additive combination to provide a lubricating oil which has acceptable piston merits performance in the VWInTD test.

The invention further provides for the use in a multigrade crankcase oil of two or more detergents comprising at least one alkali metal or alkaline earth metal phenate or salicylate which is present at a level such that the soap derived from the phenate or salicylate provides at least 10 wt % of the total soap in the composition, to provide a lubricating oil composition with acceptable ring sticking performance in the VWInTD test.

The ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The ashless dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

The oil soluble polymeric hydrocarbon backbone is selected from ethylene alpha-olefin (EAO) copolymers and alpha-olefin homo- and copolymers such as may be prepared using the new metallocene catalyst chemistry, having in each case a high degree, >30%, of terminal vinylidene unsaturation. The term alpha-olefin is used herein to refer to an olefin of the formula:

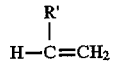

wherein R' is preferably a $C_1$–$C_{18}$ alkyl group. The requirement for terminal vinylidene unsaturation refers to the presence in the polymer of the following structure:

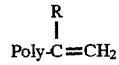

wherein Poly is the polymer chain and R is typically a $C_1$–$C_{18}$ alkyl group, typically methyl or ethyl. Preferably the polymers will have at least 50%, and most preferably at least 60%, of the polymer chains with terminal vinylidene unsaturation. As indicated in WO-A-94/19426, ethylene/1-butene copolymers typically have vinyl groups terminating no more than about 10 percent of the chains, and internal mono-unsaturation in the balance of the chains. The nature of the unsaturation may be determined by FTIR spectroscopic analysis, titration or C-13 NMR.

The oil soluble polymeric hydrocarbon backbone may be a homopolymer (e.g., polypropylene) or a copolymer of two or more of such olefins (e.g., copolymers of ethylene and an alpha-olefin such as propylene or butylene, or copolymers of two different alpha-olefins). Other copolymers include those in which a minor molar amount of the copolymer monomers, e.g., 1 to 10 mole %, is an α,ω-diene, such as a $C_3$ to $C_{22}$ non-conjugated diolefin (e.g., a copolymer of ethylene, propylene and 1,4-hexadiene or 5-ethylidene-2-norbornene). Atactic propylene oligomer typically having $\overline{M}n$ of from 700 to 5000 may also be used, as described in EP-A-490454, as well as heteropolymers such as polyepoxides.

One preferred class of olefin polymers is polybutenes and specifically poly-n-butenes, such as may be prepared by polymerization of a $C_4$ refinery stream. Other preferred classes of olefin polymers are EAO copolymers that preferably contain 1 to 50 mole % ethylene, and more preferably 5 to 48 mole % ethylene. Such polymers may contain more than one alpha-olefin and may contain one or more $C_3$ to $C_{22}$ diolefins. Also usable are mixtures of EAO's of varying ethylene content. Different polymer types, e.g., EAO, may also be mixed or blended, as well as polymers differing in $\overline{M}n$; components derived from these also may be mixed or blended.

The olefin polymers and copolymers preferably have an $\overline{M}n$ of from 700 to 5000, more preferably 2000 to 5000. Polymer molecular weight, specifically $\overline{M}n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method, particularly for lower molecular weight polymers, is vapour pressure osmometry (see, e.g., ASTM D3592).

Particularly preferred copolymers are ethylene butene copolymers.

Suitable olefin polymers and copolymers may be prepared by various catalytic polymerization processes using metallocene catalysts which are, for example, bulky ligand transition metal compounds of the formula:

$$[L]_m M[A]_n$$

where L is a bulky ligand; A is a leaving group, M is a transition metal, and m and n are such that the total ligand valency corresponds to the transition metal valency. Preferably the catalyst is four co-ordinate such that the compound is ionizable to a $1^+$ valency state.

The ligands L and A may be bridged to each other, and if two ligands A and/or L are present, they may be bridged. The metallocene compound may be a full sandwich compound having two or more ligands L which may be cyclopentadienyl ligands or cyclopentadienyl derived ligands, or they may be half sandwich compounds having one such ligand L. The ligand may be mono- or polynuclear or any other ligand capable of η-5 bonding to the transition metal.

One or more of the ligands may π-bond to the transition metal atom, which may be a Group 4, 5 or 6 transition metal and/or a lanthanide or actinide transition metal, with zirconium, titanium and hafnium being particularly preferred.

The ligands may be substituted or unsubstituted, and mono-, di-, tri, tetra- and penta-substitution of the cyclopentadienyl ring is possible. Optionally the substituent(s) may act as one or more bridges between the ligands and/or leaving groups and/or transition metal. Such bridges typically comprise one or more of a carbon, germanium, silicon, phosphorus or nitrogen atom-containing radical, and preferably the bridge places a one atom link between the entities being bridged, although that atom may and often does carry other substituents.

The metallocene may also contain a further displaceable ligand, preferably displaced by a cocatalyst—a leaving group—that is usually selected from a wide variety of hydrocarbyl groups and halogens.

Such polymerizations, catalysts, and cocatalysts or activators are described, for example, in U.S. Pat. Nos. 4,530,914, 4,665,208, 4,808,561, 4,871,705, 4,897,455, 4,937,299, 4,952,716, 5,017,714, 5,055,438, 5,057,475, 5,064,802, 5,096,867, 5,120,867, 5,124,418, 5,153,157, 5,198,401, 5,227,440, 5,241,025; EP-A-129368, 277003, 277004, 420436, 520732; and WO-A-91/04257, 92/00333, 93/08199, 93/08221, 94/07928 and 94/13715.

The preferred copolymers are ethylene butene copolymers which have an ethylene content of at least 30% preferably at least 35% and with a molecular weight of at least 2400 more preferably 2500.

The oil soluble polymeric hydrocarbon backbone may be functionalized to incorporate a functional group into the backbone of the polymer, or as one or more groups pendant from the polymer backbone. The functional group typically will be polar and contain one or more hetero atoms such as P, O, S, N, halogen, or boron. It can be attached to a saturated hydrocarbon part of the oil soluble polymeric hydrocarbon backbone via substitution reactions or to an olefinic portion via addition or cycloaddition reactions. Alternatively, the functional group can be incorporated into the polymer in conjunction with oxidation or cleavage of the polymer chain end (e.g., as in ozonolysis).

Useful functionalization reactions include: halogenation of the polymer at an olefinic bond and subsequent reaction of the halogenated polymer with an ethylenically unsaturated functional compound (e.g., maleation where the polymer is reacted with maleic acid or anhydride); reaction of the polymer with an unsaturated functional compound by the "ene" reaction absent halogenation; reaction of the polymer with at least one phenol group (this permits derivatization in a Mannich base-type condensation); reaction of the polymer at a point of unsaturation with carbon monoxide using a Koch-type reaction to introduce a carbonyl group in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil soluble polymeric hydrocarbon backbone is then further derivatized with a nucleophilic reactant such as an amine, amino-alcohol, alcohol, metal compound or mixture thereof to form a corresponding derivative. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g. polyalkylene and polyoxyalkylene polyamines of about 2 to 60, conveniently 2 to 40 (e.g., 3 to 20), total carbon atoms and about 1 to 12, conveniently 3 to 12, and preferably 3 to 9 nitrogen atoms in the molecule. Mixtures of amine compounds may advantageously be used such as those prepared by reaction of alkylene dihalide with ammonia. Preferred amines are aliphatic saturated amines, including, e.g., 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine.

Other useful amine compounds include: alicyclic diamines such as 1,4-di(aminomethyl) cyclohexane, and heterocyclic nitrogen compounds such as imidazolines. A particularly useful class of amines are the polyamido and related amido-amines as disclosed in U.S. Pat. No. 4,857,217; 4,956,107; 4,963,275; and 5,229,022. Also usable is tris(hydroxymethyl)amino methane (THAM) as described in U.S. Pat. No. 4,102,798; 4,113,639; 4,116,876; and UK 989,409. Dendrimers, star-like amines, and comb-structure amines may also be used. Similarly, one may use the condensed amines disclosed in U.S. Pat. No. 5,053,152. The functionalized polymer is reacted with the amine compound according to conventional techniques as described in EP-A 208,560; U.S. Pat. No. 4,234,435 and U.S. Pat. No. 5,229,022.

The functionalized oil soluble polymeric hydrocarbon backbones also may be derivatized with hydroxy compounds such as monohydric and polyhydric alcohols or with aromatic compounds such as phenols and naphthols. Polyhydric alcohols are preferred, e.g., alkylene glycols in which the alkylene radical contains from 2 to 8 carbon atoms. Other useful polyhydric alcohols include glycerol, monooleate of glycerol, monostearate of glycerol, monomethyl ether of glycerol, pentaerythritol, dipentaerythritol, and mixtures thereof. An ester dispersant may also be derived from unsaturated alcohols such as allyl alcohol, cinnamyl alcohol, propargyl alcohol, 1 -cyclohexane-3-ol, and oleyl alcohol. Still other classes of the alcohols capable of yielding ashless dispersants comprise the ether-alcohols and including, for example, the oxy-alkylene, oxy-arylene. They are exemplified by ether-alcohols having up to 150 oxy-alkylene radicals in which the alkylene radical contains from 1 to 8 carbon atoms. The ester dispersants may be di-esters of succinic acids or acidic esters, i.e., partially esterified succinic acids; as well as partially esterified polyhydric alcohols or phenols, i.e., esters having free alcohols or phenolic hydroxyl radicals. An ester dispersant may be prepared by one of several known methods as illustrated, for example, in U.S. Pat. No. 3,381,022.

A preferred group of ashless dispersants includes those substituted with succinic anhydride groups and reacted with polyethylene amines (e.g., tetraethylene pentamine), aminoalcohols such as trismethylolaminomethane and optionally additional reactants such as alcohols and reactive metals e.g., pentaerythritol, and combinations thereof). Also useful are dispersants wherein a polyamine is attached directly to the backbone by the methods shown in U.S. Pat. No. 3,275,554 and 3,565,804 where a halogen group on a halogenated hydrocarbon is displaced with various alkylene polyamines.

Another class of ashless dispersants comprises Mannich base condensation products. Generally, these are prepared by condensing about one mole of an alkyl-substituted mono- or polyhydroxy benzene with about 1 to 2.5 moles of carbonyl compounds (e.g., formaldehyde and paraformaldehyde) and about 0.5 to 2 moles polyalkylene polyamine as disclosed, for example, in U.S. Pat. No. 3,442,808. Such Mannich condensation products may include a polymer product of a metallocene cataylsed polymerisation as a substituent on the benzene group or may be reacted with a compound containing such a polymer substituted on a succinic arthydride, in a manner similar to that shown in U.S. Pat. No. 3,442,808.

Examples of functionalized and/or derivatized olefin polymers based on polymers synthesized using metallocene catalyst systems are described in publications identified above.

The dispersant can be further post-treated by a variety of conventional post treatments such as boration, as generally taught in U.S. Pat. Nos. 3,087,936 and 3,254,025. This is readily accomplished by treating an acyl nitrogen-containing dispersant with a boron compound selected from the group consisting of boron oxide, boron halides, boron acids and esters of boron acids, in an amount to provide from about 0.1 atomic proportion of boron for each mole of the acylated nitrogen composition to about 20 atomic proportions of boron for each atomic proportion of nitrogen of the acylated nitrogen composition. Usefully the dispersants contain from about 0.05 to 2.0 wt. %, e.g. 0.05 to 0.7 wt. % boron based on the total weight of the borated acyl nitrogen compound. The boron, which appears be in the product as dehydrated boric acid polymers (primarily $(HBO_2)_3$), is believed to attach to the dispersant imides and diimides as amine salts e.g., the metaborate salt of the diimide. Boration is readily carried out by adding from about 0.05 to 4, e.g., 1 to 3 wt. % (based on the weight of acyl nitrogen compound) of a boron compound, preferably boric acid, usually as a slurry, to the acyl nitrogen compound and heating with stirring at from 135° to 190° C., e.g., 140°–170° C., for from 1 to 5 hours followed by nitrogen stripping. Alternatively, the boron treatment can be carried out by adding boric acid to a hot reaction mixture of the dicarboxylic acid material and amine while removing water.

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. This is commonly referred to as the soap. The salts may contain a substantially stoichiometric amount of the metal in which case they are usually described as normal or neutral salts. It is possible to include large amounts of a metal base by reacting an excess of a metal compound such as an oxide or hydroxide with an acidic gas such as carbon dioxide. The resulting overbased detergent comprises neutralised detergent (soap) as the outer layer of a metal base (e.g. carbonate) micelle. Such overbased detergents may have a TBN (as may be measured by ASTM D2896) of 150 or greater, and typically of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN or higher, and neutral and overbased calcium phenates and sulfurized phenates having TBN of from 50 to 450 or higher.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 wt % (preferably at least 125 wt %) of that stoichiometrically required.

Metal salts of phenols and sulfurised phenols are prepared by reaction with an appropriate metal compound such as an oxide or hydroxide and neutral or overbased products may be obtained by methods well known in the art. Sulfurised phenols may be prepared by reacting a phenol with sulfur or a sufur containing compound such as hydrogen sulfide, sulfur monohalide or sulfur dihalide, to form products which are generally mixtures of compounds in which 2 or more phenols are bridged by sulfur containing bridges.

Unless the context dictates otherwise all references to wt % of additives in this specification are to wt % on an active ingredient basis. References to wt % soap of detergents refers to the amount of metal salt of an acidic organic compound which is present in the detergents. This may be determined in the individual detergents and mixtures of detergents by well known methods such as for example ASTM D3712 for sulfonate soap, titrimetry including two phase titrimetric methods, total acid number (TAN) as determined using ASTM D6664, by dialysis and by the use of other well known analytical techniques. Knowledge of the soap content of individual detergents allows the correct ratio of detergents to be used in an oil composition to achieve the desired ratio of soap in a oil composition.

In the compositions and concentrates of the present invention it is preferred that the detergent comprises one or more overbased sulfonate detergents most preferably one or more calcium or magnesium overbased sulfonate detergents or mixtures thereof. It is also preferred that the detergent also comprises one or more neutral metal detergents and most preferably at least one neutral metal sulfonate. It is also preferred that the phenate or salicylate or mixtures thereof is/are neutral and sulfurised.

Additional additives are typically incorporated into the compositions of the present invention. Examples of such additives are, antioxidants, anti-wear agents, friction modifiers, rust inhibitors, anti-foaming agents, demulsifiers, and pour point depressants.

The viscosity modifier functions to impart high and low temperature operability to a lubricating oil. The VM used may have that sole function, or may be multifunctional.

Multifunctional viscosity modifiers that also function as dispersants are also known and may be prepared as described above for ashless dispersants. The oil soluble polymeric hydrocarbon backbone will usually have a $\overline{M}n$ of from 20,000, more typically from 20,000 up to 500,000 or greater. In general, these dispersant viscosity modifiers are functionalized polymers (e.g. inter polymers of ethylene-propylene post grafted with an active monomer such as maleic arthydride) which are then derivatized with, for example, an alcohol or amine.

Suitable compounds for use as monofunctional viscosity modifiers are generally high molecular weight hydrocarbon polymers, including polyesters. Oil soluble viscosity modifying polymers generally have weight average molecular weights of from about 10,000 to 1,000,000, preferably 20,000 to 500,000, which may be determined by gel permeation chromatography (as described above) or by light scattering.

Representative examples of suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

The viscosity modifier used in the invention will be used in an amount to give the required viscosity characteristics. Since they are typically used in the form of oil solutions the amount of additive employed will depend on the concentration of polymer in the oil solution comprising the additive. However by way of illustration, typical oil solutions of polymer used as VMs are used in amount of from 1 to 30% of the blended oil. The amount of VM as active ingredient of the oil is generally from 0.01 to 6 wt %, and more preferably from 0.1 to 2 wt %.

Dihydrocarbyl dithiophosphate metal salts are frequently used as anti-wear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt any basic or neutral zinc compound could be used but the oxides, hydroxides and carbonates are most generally employed. Commercial additives frequently contain an excess of zinc due to use of an excess of the basic zinc compound in the neutralization reaction.

The preferred zinc dihydrocarbyl dithiophosphates are oil soluble salts of dihydrocarbyl dithiophosphoric acids and may be represented by the following formula:

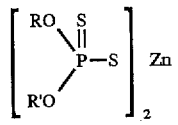

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl: methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. Conveniently at least 50 (mole) % of the alcohols used to introduce hydrocarbyl groups into the dithiophosphoric acids are secondary alcohols.

Oxidation inhibitors or antioxidants reduce the tendency of mineral oils to deteriorate in service which deterioration can be evidenced by the products of oxidation such as sludge and varnish-like deposits on the metal surfaces and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, ashless oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum containing compounds.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines. The aromatic rings are typically substituted by one or more substituents selected from alkyl, cycloalkyl, alkoxy, aryloxy, acyl, acylamino, hydroxy, and nitro groups.

Friction modifiers may be included to improve fuel economy. Oil-soluble alkoxylated mono- and diamines are well known to improve boundary layer lubrication. The amines may be used as such or in the form of an adduct or reaction product with a boron compound such as a boric oxide, boron halide, metaborate, boric acid or a mono-, di- or trialkyl borate.

Other friction modifiers are known, Among these are esters formed by reacting carboxylic acids and anhydrides with alkanols. Other conventional friction modifiers generally consist of a polar terminal group (e.g. carboxyl or hydroxyl) covalently bonded to an oleophillic hydrocarbon chain. Esters of carboxylic acids and arthydrides with alkanols are described in U.S. Pat. No. 4,702,850. Examples of other conventional friction modifiers are described by M.

Belzer in the "Journal of Tribology" (1992), Vol. 114, pp. 675–682 and M. Belzer and S. Jahanmir in "Lubrication Science" (1988), Vol. 1, pp. 3–26.

Rust inhibitors selected from the group consisting of nonionic polyoxyalkylene polyols and esters thereof, polyoxyalkylene phenols, and anionic alkyl sulfonic acids may be used.

Copper and lead bearing corrosion inhibitors may be used, but am typically not required with the formulation of the present invention. Typically such compounds are the thiadiazole polysulfides containing from 5 to 50 carbon atoms, their derivatives and polymers thereof. Derivatives of 1,3,4 thiadiazoles such as those described in U.S. Pat. Nos. 2,719,125; 2,719,126; and 3,087,932; are typical. Other similar materials are described in U.S. Pat. Nos. 3,821,236; 3,904,537; 4,097,387; 4,107,059; 4,136,043; 4,188,299; and 4,193,882. Other additives are the thio and polythio sulfenamides of thiadiazoles such as those described in UK. Patent Specification No. 1,560,830. Benzotriazoles derivatives also fall within this class of additives. When these compounds are included in the lubricating composition, they are preferably present in an amount not exceeding 0.2 wt % active ingredient.

A small amount of a demulsifying component may be used. A preferred demulsifying component is described in EP 330,522. It is obtained by reacting an alkylene oxide with an adduct obtained by reacting a bis-epoxide with a polyhydric alcohol. The demulsifier should be used at a level not exceeding 0.1 mass % active ingredient. A treat rate of 0.001 to 0.05 mass % active ingredient is convenient.

Pour point depressants, otherwise known as lube oil flow improvers, lower the minimum temperature at which the fluid will flow or can be poured. Such additives are well known. Typical of those additives which improve the low temperature fluidity of the fluid are $C_8$ to $C_{18}$ dialkyl fumarate/vinyl acetate copolymers and polyalkylmethacrylates.

Foam control can be provided by many compounds including an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and does not require further elaboration.

When lubricating compositions contain one or more of the above-mentioned additives, each additive is typically blended into the base oil in an amount which enables the additive to provide its desired function. Representative effective amounts of such additives, when used in crankcase lubricants, are listed below. All the values listed are stated as mass percent active ingredient.

| ADDITIVE | MASS % (Broad) | MASS % (Preferred) |
|---|---|---|
| Ashless Dispersant | 0.1–20 | 1–8 |
| Detergent | 0.1–15 | 0.2–9 |
| Corrosion Inhibitor | 0–5 | 0–1.5 |
| Metal dihydrocarbyl dithiophosphate | 0.1–6 | 0.1–4 |
| Supplemental anti-oxidant | 0–5 | 0.01–1.5 |
| Pour Point Depressant | 0.01–5 | 0.01–1.5 |
| Anti-Foaming Agent | 0–5 | 0.001–0.15 |
| Supplemental Anti-wear Agents | 0–0.5 | 0–0.2 |
| Friction Modifier | 0–5 | 0–1.5 |
| Viscosity Modifier[1] | 0.01–6 | 0–4 |
| Mineral or Synthetic Base Oil | Balance | Balance |

[1]Viscosity Modifiers are used only in a multigrade oil

It is most preferred that detergent is present in the lubricating composition in the range 1 to 3 wt %. It is preferred that the lubricating composition comprises up to 1.2 wt % of at least one overbased sulfonate and more preferably comprises at least 0.85 wt % of at least one overbased sulfonate. It is also preferred that the composition comprises up to 0.4 wt % of at least one neutral metal sulfonate, up to 1.0 wt % of at least one metal phenate or salicylate or mixtures thereof, most preferably at least 0.45 wt % of at least one metal phenate or salicylate or mixtures thereof. It is also preferred that the lubricating oil composition comprises up to 0.85 wt % of at least one sulfurised phenol and most preferably comprises at least 0.32 wt % of at least one sulfurised phenol. This sulfurised phenol may be present as an additional detergent are may constitute part or all of the supplemental anti-oxidant in the composition.

It is preferred that the lubricating composition comprises greater than 1.25 wt % or more of soap and more preferably the soap is present in the range 1.25 wt % to 2 wt %.

The components may be incorporated into a base oil in any convenient way. Thus, each of the components can be added directly to the oil by dispersing or dissolving it in the oil at the desired level of concentration. Such blending may occur at ambient temperature or at an elevated temperature. The basestock used in the lubricating oil may be selected from any of the synthetic or natural oils used as crankcase lubricating oils for spark-ignited and compression-ignited engines. The lubricating oil base stock conveniently has a viscosity of about 2.5 to about 12 $mm^2/s$ and preferably about 2.5 to about 9 $mm^2/s$ at 100° C. Mixtures of synthetic and natural base oils may be used if desired.

Preferably all the additives except for the viscosity modifier and the pour point depressant are blended into a concentrate or additive package described herein as the detergent inhibitor package, that is subsequently blended into basestock to make finished lubricant. Use of such concentrates is conventional. The concentrate will typically be formulated to contain the additive(s) in proper amounts to provide the desired concentration in the final formulation when the concentrate is combined with a predetermined amount of base lubricant.

Preferably the concentrate is made in accordance with the method described in U.S. Pat. No. 4,938,880. That patent describes making a premix of ashless dispersant and metal detergents that is pre-blended at a temperature of at least about 100° C. Thereafter the pre-mix is cooled to at least 85° C. and the additional components are added.

The final formulations may employ from 2 to 15 mass % and preferably 5 to 10 mass %, typically about 7 to 8 mass % of the concentrate or additive package with the remainder being base oil.

It is preferred that the concentrates of the present invention comprise at least 12.5 wt % or greater of soap and preferably comprise up to 20 wt % of soap. It is preferred that the concentrates comprise up to 30 wt % of detergent and most preferably at least 17 wt % of detergent.

The invention will now be described by way of illustration only, with reference to the following examples. In the examples, unless otherwise noted, all treat rates of all additives are reported as mass percent active ingredient.

EXAMPLES

A series of 15W/40 multigrade crankcase lubricating oils were prepared from a lubricating oil basestock and a proprietary additive package comprising antioxidants, a viscosity modifier, dispersant, a ZDDP, a friction modifier, a demulsifier, anti-foam and compatability aids.

As a comparison a formulations were prepared using conventional borated polyisobutenesuccinic anhydride/ polyamine ashless dispersants; derived from a polyisobutene of $\overline{M}n$=2225. Formulations according to the present invention were based on an ashless dispersants derived from ethylene/butylene copolymer backbones of various molecular weight and ethylene content, functionalised by the introduction of a carbonyl group by the Koch reaction which is in turn reacted with a polyamine and borated (EBCO/PAM) the details of these dispersants are given in Table 1.

TABLE 1

| Dispersant | Type[1] | Polymer $\overline{M}n$ (GPC) | Ethylene % |
|---|---|---|---|
| 1 | EBCO/PAM | 2400 | 39 |
| 2 | EBCO/PAM | 3250 | 46 |
| 3 | EBCO/PAM | 3300 | 48 |
| 4 | PIBSA/PAM | 2200 | 0 |

Footnotes:
[1]EBCO/PAM = borated dispersant prepared by aminating with a polyamine an ethylene/butene copolymer functionalised with a carbonyl group by use of the Koch reaction as described in USSN 992403; PIBSA/PAM = borated polyisobutenyl succinimide dispersant.

Each lubricating oil composition in Table 1 comprised a major proportion of base lubricating oil, and a quantity of viscosity modifier required to impart 15W40 multigrade performance. In each formulation various detergent combinations were used selecting from the following detergents; a 400 TBN magnesium sulfonate, a 300 TBN calcium sulfonate, a 25 TBN calcium sulfonate, a calcium phenate, and one or more sulfurised phenols. Details of the formulations used are given in Table 2. In table 2 the wt % of detergent combination includes soap and other active components of the detergent. Apart from the combinations and levels of detergent there were further differences between some of the formulations which are not believed to have had any significant effect on the performance of these formulations in the VWInTD engine test. Comparative Examples 1, 3, 4, 5, 6, 7 and Examples 3, 6, 7, and 8 used the same additive package with a diphenylamine as antioxidant. Examples 1 and 2 differed only in that an additional 25% of a high molecular weight carboxylic acid compatibility aid was used. Comparative Example 2 differed in that the diphenylamine antioxidant was replaced with a hindered phenol antioxidant, a different ZDDP was also used at a lower level and the friction modifier was omitted. Examples 4 and 5 differed in that they had hindered phenol antioxidant present in addition to the diphenylamine at a level which was 30% of the amount present in Comparative Example 2 and, as with Examples 1 and 2, 25% additional compatibility aid.

These formulations were tested in the VWInTD and in the Sequence VE test. The VWInTD engine test is undertaken with a Volkswagen 1.6 Intercooled Turbocharged diesel engine and run according to the industry standard CEC L-46-T-93 procedure. New pistons were used at the start of each test and the piston cleanliness following each test rated visually according to standard procedure DIN 51 361, part 2 and recorded as 'piston merits' on a numerical scale of from 0 to 100, with a higher numerical value corresponding to a lower level of piston deposits. The test is typically used as a "pass/fail" performance test, whereby a lubricating oil composition must achieve at least 70 piston merits to be considered a "pass" for diesel piston cleanliness. The results of these tests are presented in Table 2.

In Table 2 Examples 1 to 8 are examples of the present invention with examples 1, 4, 5, 6 7 and 8 having acceptable piston merit performance in addition to good ring stick performance. Comparative Examples 4, 5, 6 and 7 clearly show the need for phenate to achieve ring stick pass in the VWInTD.

TABLE 2

| Component Wt % | Dispersant | Comp Ex 1 | Comp Ex 2 | Comp Ex 3 | Comp Ex 4 | Comp Ex 5 | Comp Ex 6 | Comp Ex 7 | Ex 1 | Ex 2 | Ex 3 | Ex 4 | Ex 5 | Ex 6 | Ex 7 | Ex 8 |
|---|---|---|---|---|---|---|---|---|---|---|---|---|---|---|---|---|
| PIBSA/PAM | 4 | 3.0 | — | — | — | — | — | — | — | — | — | — | — | — | — | — |
| EBCO/PAM | 1 | — | — | — | — | — | — | — | — | 2.4 | — | — | — | — | — | — |
| | 2 | — | 3.0 | 3.0 | 3.0 | 3.0 | 3.0 | 3.0 | — | — | 3.0 | 2.4 | 3.0 | 3.0 | 3.0 | 3.0 |
| | 3 | — | — | — | — | — | — | — | 2.7 | — | — | — | — | — | — | — |
| Mix. of HBNS Sulphonates | | 0.88 | 1.15 | 0.88 | 1.15 | 0.88 | 0.88 | 0.88 | 0.88 | 0.88 | 0.88 | 0.88 | 0.88 | 1.15 | 1.16 | 1.15 |
| LBNS Ca Sulphonate | | 0.39 | 0.39 | 0.39 | 0.39 | 0.39 | 0.39 | 0.39 | 0.39 | 0.39 | 0.39 | 0.39 | 0.39 | 0.39 | 0.39 | 0.39 |
| Ca Phenate | | 0.46 | 0.51 | 0.92 | — | — | — | — | 0.46 | 0.46 | 0.46 | 0.46 | 0.46 | 0.92 | 0.92 | 0.92 |
| wt % Detergent Combination | | 1.73 | 2.05 | 2.19 | 1.54 | 1.27 | 1.27 | 1.27 | 1.73 | 1.73 | 1.73 | 1.73 | 1.73 | 2.46 | 2.47 | 2.46 |
| Sulphurised Phenol | | — | 0.33 | — | — | 0.85 | 0.85 | — | — | — | — | 0.33 | 0.33 | 0.85 | 0.85 | — |
| A Total Soap | | 1.26 | 1.46 | 1.69 | 0.99 | 0.84 | 0.84 | 0.84 | 1.26 | 1.26 | 1.26 | 1.26 | 1.26 | 1.84 | 1.81 | 1.84 |
| B Sulphonate Soap | | 0.84 | 0.99 | 0.84 | 0.99 | 0.84 | 0.84 | 0.84 | 0.84 | 0.84 | 0.84 | 0.84 | 0.84 | 0.99 | 0.96 | 0.99 |
| C Phenate soap | | 0.42 | 0.47 | 0.85 | — | — | — | — | 0.42 | 0.42 | 0.42 | 0.42 | 0.42 | 0.85 | 0.85 | 0.85 |
| Ratio C/B | | 0.5 | 0.47 | 1.01 | — | — | — | — | 0.5 | 0.5 | 0.5 | 0.5 | 0.5 | 0.88 | 0.89 | 0.86 |
| Ratio C/A | | 0.33 | 0.32 | 0.5 | — | — | — | — | 0.33 | 0.33 | 0.33 | 0.33 | 0.33 | 0.46 | 0.47 | 0.46 |
| VW In TD | Piston Merits | 73 | 67 | 63 | 61 | 69 | 68 | 68 | 72 | 69 | 69 | 74 | 73 | 73 | 71 | 72 |
| | Ring stick | 0 | 6 | 20 | 25 | 20 | 15 | 12.5 | 0 | 0 | 0 | 0 | 0 | 0 | 0 | 0 |
| Sequence | Sludge | 8.945 | — | — | — | — | — | — | — | — | — | 9.1 | 9.4 | — | — | — |
| VE | Varnish | 4.95 | | — | — | — | — | — | — | — | — | 5.8 | 6.3 | — | — | — |

I claim:

1. A lubricating oil composition meeting at least the requirements of the Sequence VE test, said composition comprising:

(a) an oil of lubricating viscosity, (b) an ashless dispersant comprising an oil-soluble polymeric backbone having functional groups in which the hydrocarbon backbone is derived from an ethylene alpha-olefin (EAO) copolymer or alpha-olefin homo- or copolymer having greater than 30% of terminal vinylidene unsaturation, and (c) two or more detergents comprising at least one alkali metal or alkaline earth metal phenate or salicylate which is present at a level such that the soap derived from the phenate or salicylate provides >32 and <50 wt % of the total soap in the composition.

2. A composition as claimed in claim 1 wherein the second detergent comprises sulfonate soap.

3. A composition as claimed in claim 1 comprising 1.25 wt % or greater of soap.

4. A composition as claimed in claim 1 comprising up to 2 wt % of soap.

5. A composition as claimed in claim 1 comprising up to 3 wt % of detergent.

6. A composition as claimed in claim 2 which comprises up to 1.2 wt % of at least one overbased sulfonate.

7. A composition as claimed in claim 2 which comprises at least 0.85 % wt of at least one overbased sulfonate.

8. A composition as claimed in claim 2 which comprises up to 0.4 wt % of at least one neutral metal sulfonate.

9. A composition as claimed in claim 1 which comprises up to 1.0 wt % of at least one metal phenate or salicylate or mixtures thereof.

10. A composition as claimed in claim 1 which comprises at least 0.45 wt % of at least one metal phenate or salicylate or mixtures thereof.

11. A composition as claimed in claim 1 wherein the phenate or salicylate is a neutral phenate or salicylate.

12. A composition as claimed in claim 1 which comprises up to 0.85 wt % of at least one sulfurised phenol.

13. A composition as claimed in claim 1 which comprises at least 0.3 wt % of at least one sulfurised phenol.

14. A composition as claimed in claim 1 wherein the oil soluble polymeric backbone has a number average molecular weight ($\overline{Mn}$) within the range of from 500 to 5,000.

15. A composition as claimed in claim 14 where the $\overline{Mn}$ of the polymer backbone is within the range of 700 to 5000.

16. A composition as claimed in claim 14 wherein the $\overline{Mn}$ of the polymer backbone is within the range of 2000 to 5000.

17. A composition as claimed in claim 1 wherein the oil soluble polymeric backbone has an ethylene content of 5 to 48 wt %.

18. A composition as claimed in claim 1 wherein the alpha olefin is butene.

19. A lubricating oil concentrate comprising;

(a) an oil of lubricating viscosity as a minor component;

(b) an ashless dispersant comprising an oil-soluble polymeric backbone having functional groups in which the hydrocarbon backbone is derived from an ethylene alpha-olefin (EAO) copolymer or alpha-olefin homo- or copolymer having greater than 30% of terminal vinylidene unsaturation, and (c) two or more detergents comprising at least one alkali metal or alkaline earth metal phenate or salicylate which is present at a level such that the soap derived from the phenate or salicylate provides >32 and <50 wt % of the total soap in the concentrate.

20. A concentrate as claimed in claim 19 comprising 12.5 wt % or greater of soap.

21. A concentrate as claimed in claim 19 comprising up to 30 wt % of detergent.

22. An additive combination for incorporating into a lubricating oil to provide a lubricating oil composition with acceptable ring sticking performance in a VWInTD test of the lubricating oil composition, the additive combination comprising:

(a) an ashless dispersant comprising an oil-soluble polymeric backbone having functional groups in which the hydrocarbon backbone is derived from an ethylene-olefin (EAO) copolymer or alpha-olefin homo- or copolymer having greater than 30% of terminal vinylidene unsaturation, and (b) two or more detergents comprising at least one alkali metal or alkaline earth metal phenate or salicylate which is present in the combination at a level such that the soap derived from the phenate or salicylate provides at least 10 wt % of the total soap in the detergent combination.

23. The additive combination as claimed in claim 22 to provide a lubricating oil composition also having acceptable piston merits performance in the VWInTD test.

* * * * *